United States Patent [19]

Whiteley

[11] Patent Number: 4,696,436

[45] Date of Patent: Sep. 29, 1987

[54] MULTI-POSITION YARN SPINNING/WINDING APPARATUS

[75] Inventor: John Whiteley, Clitheroe, England

[73] Assignee: Hollingsworth (UK) Limited, Accrington, England

[21] Appl. No.: 920,101

[22] Filed: Oct. 16, 1986

[30] Foreign Application Priority Data

Jun. 20, 1986 [GB] United Kingdom ..... 8615090

[51] Int. Cl.[4] ..... B65H 54/20; B65H 54/28

[52] U.S. Cl. ..... 242/35.5 R; 242/43 R

[58] Field of Search ..... 242/35.5 R, 43 R, 43 A, 242/43 B, 43 M, 43.1, 158 R, 158 B, 158 F, 158.1, 158.2, 158.3, 158.4 R, 158.4 A, 158.5

[56] References Cited

U.S. PATENT DOCUMENTS

| | | | |
|---|---|---|---|
| 2,301,699 | 11/1942 | Helland | 242/35.5 R |
| 2,301,712 | 11/1942 | Seem et al. | 242/35.5 R |
| 2,400,324 | 5/1946 | Winslow | 242/35.5 R |
| 2,563,642 | 8/1951 | Columbu et al. | 242/35.5 R |
| 2,889,577 | 6/1959 | Winer | 242/35.5 R |
| 3,018,974 | 1/1962 | Mattingly et al. | 242/35.5 R |
| 3,235,192 | 2/1966 | Scragg | 242/35.5 R |
| 3,279,711 | 10/1966 | Schippers et al. | 242/35.5 R |
| 3,642,217 | 2/1972 | Sistare et al. | 242/35.5 R |
| 4,062,503 | 12/1977 | Chaplin, Jr. et al. | 242/35.5 R |
| 4,157,793 | 6/1979 | Lucia | 242/35.5 R |

*Primary Examiner*—Stanley N. Gilreath
*Attorney, Agent, or Firm*—Cort Flint

[57] ABSTRACT

A multi-position open-end spinning machine has the directions of traverse of the traverse guides of some groups of its spinning positions opposed to the simultaneous direction of traverse of the traverse guides of the spinning positions in other groups. Alternatively some traverse guides in a particular group of spinning positions may be in opposition to other traverse guides in the same group. The phase angles of the traverse guide motions may be distributed to have several different phase angles along the machine for noise reduction. The invention may also be applied to any multi-position winding machine.

10 Claims, 9 Drawing Figures

MULTI-POSITION YARN SPINNING/WINDING APPARATUS

FIELD OF THE INVENTION

The present invention relates to a multi-position yarn handling apparatus incorporating a yarn winder at each of the stations along the machine, wherein the yarn winders simultaneously traverse the yarn to form packages on take-up spools.

PRIOR ART

For many years, multi-position yarn winding has been carried out both in winding apparatus and in spinning apparatus of various kinds, including open-end spinning and traditionally the traverse mechanisms are all synchronized so that all of the traverse guides move towards one end of the machine simultaneously in order to derive drive from a common reciprocating unit. It has also been proposed, in the past, to provide sub-assemblies of traverse drive mechanisms but always with the traverses synchronized so that the traverse guides move together in the same direction.

OBJECT OF THE INVENTION

It has been found that with increasing yarn delivery speeds from recently developed open end spinning machines (up to 300 m/min. in the case of a friction spinning machine) machine vibration levels are increasing and it is an object of the present invention to mitigate this effect.

SUMMARY OF THE INVENTION

In accordance with one aspect of the present invention we provide a multi-position yarn spinning and/or winding apparatus including yarn package-forming means including traverse means to traverse the yarn across a package former, wherein the traverse guides of some of the positions of the multi-position machine are traversing in a first direction while the traverse guides of others of the positions on the same side of the machine are traversing in the opposite direction along the machine frame.

A second aspect of the invention provides a multi-position yarn spinning and/or winding apparatus including yarn package-forming means at each position with traverse means to traverse the yarn across a package former, wherein all or most traverse guide motions are phased in pairs of positions which are not necessarily alongside one another, such that in any one said pair of positions on the same side of the machine the traverse guide motions are directly out of phase, and wherein at least two of the pairs have the phase angles of the first pair out of phase by an angle of less than 180° with the traverse motion phase angles of the second said pair.

BRIEF DESCRIPTION OF THE DRAWINGS

In order that the present invention may more readily be understood the following description is given, merely by way of example, with reference to the accompanying drawing in which.

DESCRIPTION OF THE PREFERRED EMBODIMENTS

Figure 1:
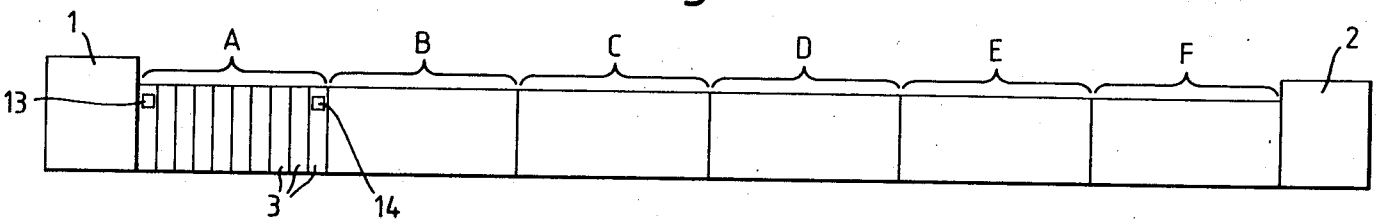
FIG. 1 is a side elevational view of a 144 position open-end spinning unit in accordance with the present invention.
Figure 3:
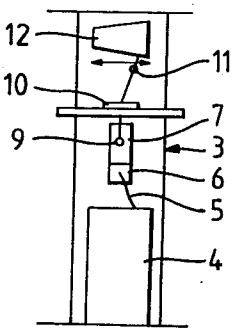
FIG. 3 is an elevational view of a typical spinning position of the machine of FIGS. 1 and 2.

As shown in FIG. 1, the 144 position machine has a gearing end casing 1 at the left hand end and an off-end casing 2 at the right hand end, with six separate bays A, B, C, D, E, and F each including twenty-four separate spinning positions (twelve on each side) one of which positions is shown in more detail in FIG. 3.

As shown in FIG. 3, the typical spinning position 3 includes a sliver can 4 from which sliver 5 is withdrawn as it is entrained into the fibre-opening unit 6 including a beater roll (not shown).

From the fibre-opening unit the sliver, separated into individual airborne fibres, is pneumatically entrained into a spinning chamber 7 and is spun to form a yarn leaving the chamber 7 by way of the conventional doffing tube 9. The spun yarn then passes over delivery rollers 10 to enter the traverse fan in which the yarn is caused to traverse laterally by engagement with a traverse guide 11 as it is wound onto a package 12, in this case a conical build-up on a conical winding tube serving as package former.

The open-end spinning unit shown in FIG. 3 may be a rotor spinner or a friction spinner, and equally the present invention can be applied to any multi-position machine in which winding-up of yarn onto individual packages takes place.

Figure 2:
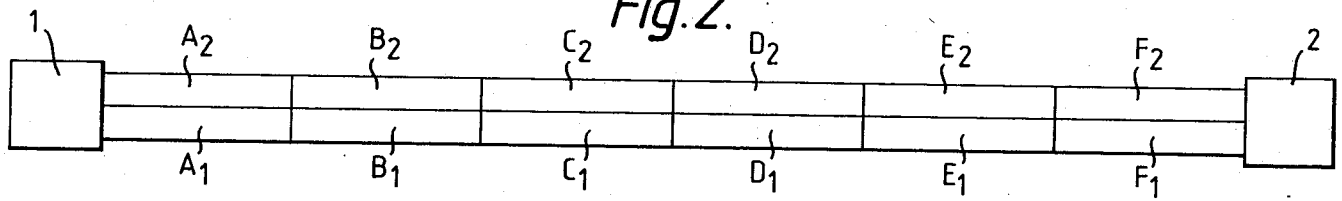
FIG. 2 is a top plan view of the multi-position spinning unit of FIG. 1.

As shown in plan view in FIG. 2, the various machine bays A . . . F include front sets of positions A1 . . . F1 all back-to-back with other sets of positions A2 . . . F2. Thus with this machine, having six bays with twelve positions on each side of each bay, there is a total of 144 positions divided up into six bays of twenty-four.

In accordance with the present invention we propose that not all of the traverse guides 11 traverse in the same direction simultaneously.

Figure 4:
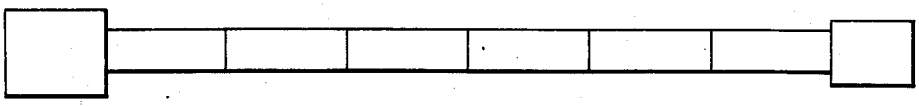
FIG. 4 is a schematic view of a typical spinning machine in accordance with the invention divided into bays with graphs illustrating phasing shown in FIGS. 4A–4E.
Figure 4A:
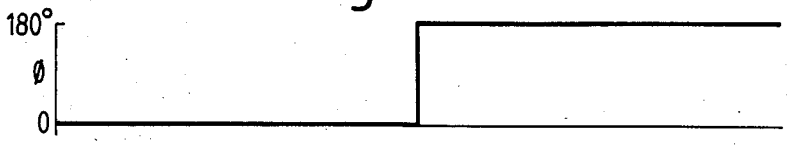
FIGS. 4A to 4E are diagrammatic representations of the varying phase angles of the winding units of the 72 various positions along one side of various embodiments of the machine shown in FIG. 4.
Figure 4B:
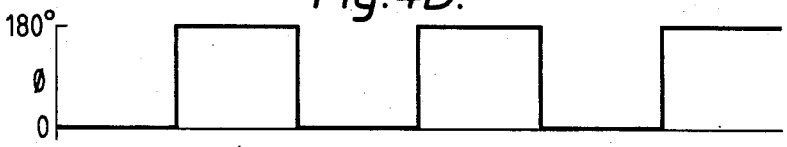

For example, the traverse guides of the sets of positions A1, A2, B1, B2, C1 and C2, i.e. of the three bays A, B and C at one end of the machine, may all be moving towards the gearing end 1 while the traverse guides of the remaining positions D1, D2, E1, E2, F1 and F2 are all moving away from the gearing casing 1. This condition is illustrated diagrammatically in FIG. 4A showing phasing of the spinning units located in the bays of FIG. 4. Another possibility is for the traverse guides of the sets of positions A1, A2, C1, C2, E1 and E2, i.e. of bays A, C, and E, to be moving in one direction while the traverse guides of the remaining sets of positions B1, B2, D1, D2, F1 and F2 are moving in the opposite direction. This condition is illustrated diagrammatically in FIG. 4B.

Figure 4C:
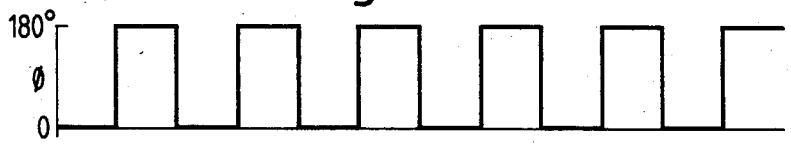

Yet a further possibility, where there are two traverse actuators to each side of each bay, such as shown at 13 and 14 in bay A on FIG. 1, is to have the traverse guides of the first six positions starting from the gearing end casing 1 travelling in a first direction (as they are all driven by a first traverse actuator 13 in FIG. 1) while the remaining six positions on each side of the bay A (driven by the second traverse actuator 14) are traversing in the reverse direction. This condition is illustrated diagrammatically in FIG. 4C.

Figure 4D:
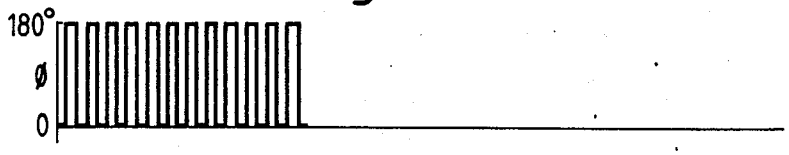

Yet a further possibility, where each of the positions has its own traverse actuator, will be for each alternate position along a bay, such as bay A, to have the same direction of traverse while the intervening positions have the opposite direction. This condition is illustrated diagrammatically in FIG. 4D.

It is preferred, but not necessary, that in the case of each pair of positions which are back-to-back (for example the two open-end spinning units which are directly adjacent the gearing end casing 1 in the bay A) to have the same direction of traverse, i.e. either towards or away from the gearing casing 1.

The reversal of the direction of traverse between some positions and others assists in avoiding undue vibration of the machine at critical traverse frequencies, i.e. at high yarn speeds or when building packages with high angles of winding. Despite the fact that the moving mass of a yarn traverse guide is very small compared with the mass of the machine as a whole, we believe it is advantageous to arrange for the movement of some of the guides to be opposed to that of other of the guides.

In the embodiments described above, there are two phase angles present in the traverse motions on the machine, exactly 180° out of phase with one another. These are represented by the values 0 and 180 on the diagrammatic representations of FIGS. 4A, 4B, 4C and 4D.

Figure 4E:
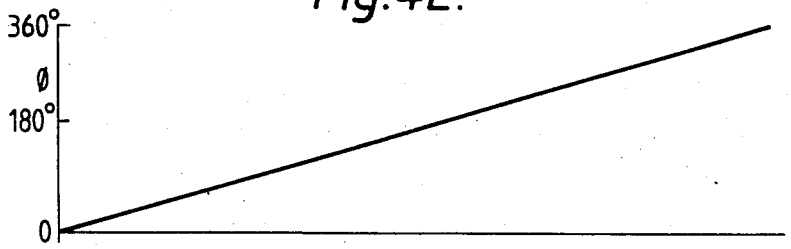

FIG. 4E shows a further embodiment which is particularly advantageous in that the phase angles differ by much smaller increments.

Along the length of the machine, represented by the abscissa in FIGS. 4A to 4E, the phase angle in this further embodiment is arranged such that there are many pairs of phase-linked traverse guides which are directly in opposition to one another. This situation is represented by the two points X on the graph of FIG. 4E. In particular these points denote positions numbers 24 and 60 along one side of the machine. Thus the phase angles of these two positions are directly opposed to one another and the same two positions on the opposite side of the machine (where the number is always measured from the gearing end 1 of the machine) may have exactly the same two 180° opposed phase angles.

As can be seen from the straight line illustration of the plot of phase angles in FIG. 4E (which is of course a graph where the plots of FIGS. 4A to 4D are bar graphs) there are many different pairs of phase-linked traverse guides covering the full range of phase angles up to 360 °.

In this preferred form of the alternative embodiment the traverse motion phase angle differs from one position to the next by an increment of 5° (in order to cover the full range with uniform increments over 72 spinning stations per side of the machine). However, it is not essential for adjacent positions to have their phase angle differing by this incremental amount, and any other random location of the phase-linked positions is possible provided the positions are linked in pairs with direct 180° opposition of phase between the two positions of each pair.

I claim:

1. Multi-position yarn handling machine including:

(a) a plurality of yarn handling positions along the machine;

(b) respective yarn package-forming means including a package former at each said position;

(c) respective traverse guide means for each package-forming means for traversing the yarn across said package former; and (d) means driving the traverse guide means such that at least the majority of said traverse means execute traverse guide motions phased such that pairs of said positions which are not necessarily alongside one another but are on the same side of the machine have the traverse guide motions of their traverse means directly out of phase, wherein said pairs comprise a first pair having a first phase angle and a second pair having a second phase angle, such that the first phase angle is less than 180° displaced from the second phase angle.

2. Multi-position yarn handling machine according to claim 1, wherein said yarn handling positions each include an open end spinning unit.

3. Multi-position yarn handling machine including (a) a plurality of yarn handling positions along the machine;

(b) respective yarn package-forming means including a package former at each said position;

(c) respective yarn traverse guide means for each package forming means for traversing the yarn across said package former; and (d) means driving the traverse guide means such that the traverse guide means of some of said positions of the multi-position machine are traversing in a first direction while the traverse guide means of others of said positions on the same side of the machine are traversing in a second direction along the machine, said first and second directions being opposed to one another.

4. A machine according to claim 3, wherein the traverse guide means of half of the positions of the machine are driven to traverse in said first direction while the traverse guide means of the other half of the positions of the machine are driven to traverse in said second direction.

5. A machine according to claim 4, wherein the machine is divided so that between a first end of the machine and the center thereof all of the positions have their traverse guide means driven to move in said first direction while in the part of the machine between said center and the second end of the machine the traverse guide means are all driven to traverse in said second direction.

6. A machine according to claim 3, comprising a plurality of bays each comprising several said positions, wherein all of the traverse guide means in the positions of one of said bays are being driven to traverse in said first direction at the same time, but at that same time the traverse guide means of all the positions of at least one other of said bays are being driven to traverse in said second direction.

7. A machine according to claim 6, wherein the drive means to each of said bays comprise respective first and second traverse actuator means connected such that said first traverse actuator means drives the traverse guide means of some of said positions in said bay for traversing in said first direction while the second traverse actuator drives the traverse guide means of the remainder of said positions in said bay for traversing in said second direction.

8. A machine according to claim 3, wherein said drive means to the traverse guide means comprise a respective traverse actuator to each said position of said machine, and wherein the alternate positions along the machine have their traverse actuators driving the traverse guide means for traversing movement in said first direction while the intervening positions have their traverse actuators driving the traverse guide means for traversing movement in said second direction.

9. A machine according to claim 3, wherein the machine has first and second sides with pairs of back-to-back positions along the machine, each said pair having a first position on said first side back-to-back with a second position on said second side, each of said pairs of back-to-back positions of the machine being arranged so that its two positions traverse in the same direction along the machine.

10. A multi-position yarn handling machine according to claim 3, wherein each said position includes an open end spinning unit.

* * * * *